US007762508B2

(12) United States Patent
Xu

(10) Patent No.: US 7,762,508 B2
(45) Date of Patent: Jul. 27, 2010

(54) FIXING STRUCTURE OF A ROD MEMBER FOR USE IN SHOWER CURTAINS

(75) Inventor: Ming-He Xu, Taichung (TW)

(73) Assignee: Ming-He Wang, Taichung (TW)

( * ) Notice: Subject to any disclaimer, the term of this patent is extended or adjusted under 35 U.S.C. 154(b) by 381 days.

(21) Appl. No.: 11/879,301

(22) Filed: Jul. 17, 2007

(65) Prior Publication Data

US 2009/0020671 A1 Jan. 22, 2009

(51) Int. Cl.
*A47H 1/10* (2006.01)

(52) U.S. Cl. ..... 248/264; 248/251; 4/610

(58) Field of Classification Search ..... 248/251, 248/264, 268; 211/105.1, 105.2; 4/557, 4/558, 608, 610; D8/376; D23/304
See application file for complete search history.

(56) References Cited

U.S. PATENT DOCUMENTS 5,894,600 A * 4/1999 Chenefront ..... 2/69
7,127,777 B2 * 10/2006 Chiang ..... 16/252
7,346,940 B1 * 3/2008 Liao ..... 4/558

* cited by examiner

*Primary Examiner*—Gwendolyn Baxter
(74) *Attorney, Agent, or Firm*—Pro-Techtor Int'l Services; Ralph Willgohs

(57) ABSTRACT

A fixing structure of a rod member for use in shower curtains comprises a holder, a connecting member and two cover pieces screwed at the end portions of the holder, wherein the holder includes a fixing groove formed therein and a gap, the width of which is less than the diameter of the fixing grove, arranged at one side thereof, and includes a connecting member axially disposed in the fixing groove thereof and having pivotal shafts mounted at two end portions thereof, and having an insertion notch for inserting a rod member therein secured on the outer peripheral surface thereof, and includes the cover pieces screwed at two end portions thereof and having axial opening in response to the pivotal shafts of the connecting member attached thereon, thereby utilizing the connecting member to fixing various types of rod members.

17 Claims, 15 Drawing Sheets

FIXING STRUCTURE OF A ROD MEMBER FOR USE IN SHOWER CURTAINS

BACKGROUND OF THE INVENTION

1. Field of the Invention

The present invention relates to a fixing structure of a rod member for use in shower curtains that may utilize connecting member to fixing various types of rod members.

2. Description of the Prior Arts

Referring to FIGS. 1 and 2, a prior art fixing structure of a rod member for use in shower curtains comprises a holder 10 and a connecting member 11. The holder 10 includes tabs 101, 102 provided at two sides thereof respectively, for screwing with a bolt element 103. Between the tabs 101, 102 is arranged a receiving compartment including bores 104 formed at one side thereof for fixing bolt elements on the wall. The receiving compartment includes the connecting member 11 axially disposed therein and having a coupling tube 111 mounted at one side thereof, and the coupling tube 111 includes an axial bore 112 attached therein and a fixing cylinder 113 extendedly secured on the outer surface thereof for fitting a rod member 20, and includes a bolt element 114 for screwing with the rod member 20 arranged on the outer surface thereof. In assembly, the two holders 10, 10' are fixed on the walls, and then the fitting cylinders 113, 113' of the connecting members 11, 11' are fitted into the two ends of the rod member 20, and by using the bolt element 114, a coupling tube 111' of the connecting member 11' is placed in the receiving compartment of the holder 10', and by way of the holes of tabs 101', 102', a bolt element 103' is screwed, such that one end of the rod member 20 is axially connected to the holder 10', and then by way of the holes of the tabs 101, 102, a bolt element 103 is screwed, such that another end of the rod member 20 is axially connected to the holder 10, thus fixing the rod member 20. However, such a prior art fixing structure of a rod member for use in shower curtains still has the following defects:

1. If some errors occur between the relative positions of the holders 10, 10' and the connecting members 11, 11', it is difficult to fix the rod member 20 in the holder 10, 10'.

2. The shower curtain is hard to be pulled closely to the holder 10, 10', thus leaving the gaps between the shower curtain and the walls.

The present invention has arisen to mitigate and/or obviate the afore-described disadvantages.

SUMMARY OF THE INVENTION

The primary object of the present invention is to provide a fixing structure of a rod member for use in shower curtains that may utilize connecting member to fixing various types of rod members.

In accordance with one aspect of the present invention, there is provided a fixing structure of a rod member for use in shower curtains comprising a holder, a connecting member and two cover pieces screwed at the end portions of the holder, wherein the holder includes a fixing groove formed therein and a gap, the width of which is less than the diameter of the fixing groove, arranged at one side thereof, and includes a connecting member axially disposed in the fixing groove thereof and having pivotal shafts mounted at two end portions thereof, and having an insertion notch for inserting a rod member therein secured on the outer peripheral surface thereof, and includes the cover pieces screwed at two end portions thereof and having an axial opening in response to the pivotal shafts of the connecting member attached thereon.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
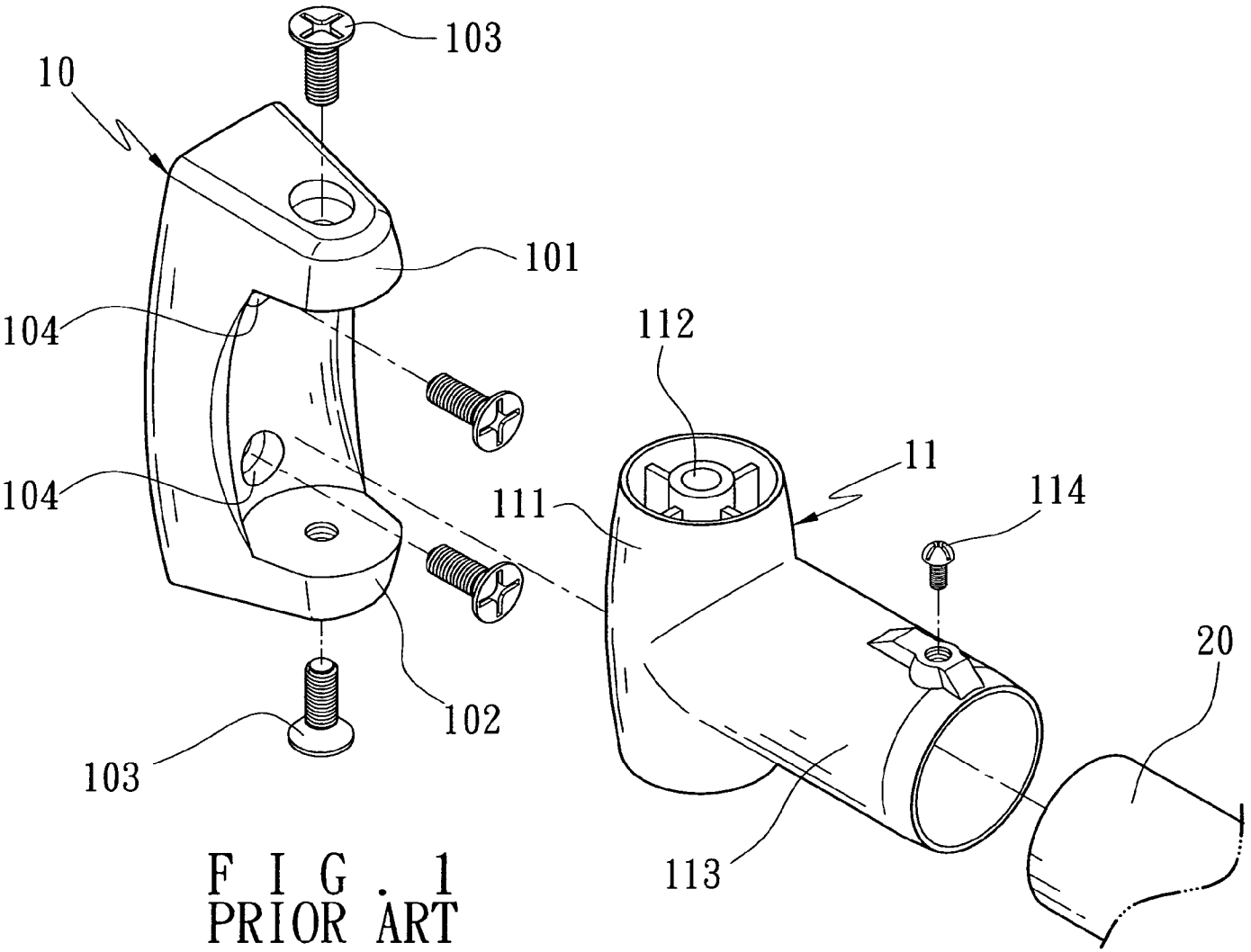
FIG. 1 PRIOR ART
FIG. 1 is a perspective diagram illustrating the exploded components of a prior art fixing structure of a rod member for use in shower curtains.
Figure 2:
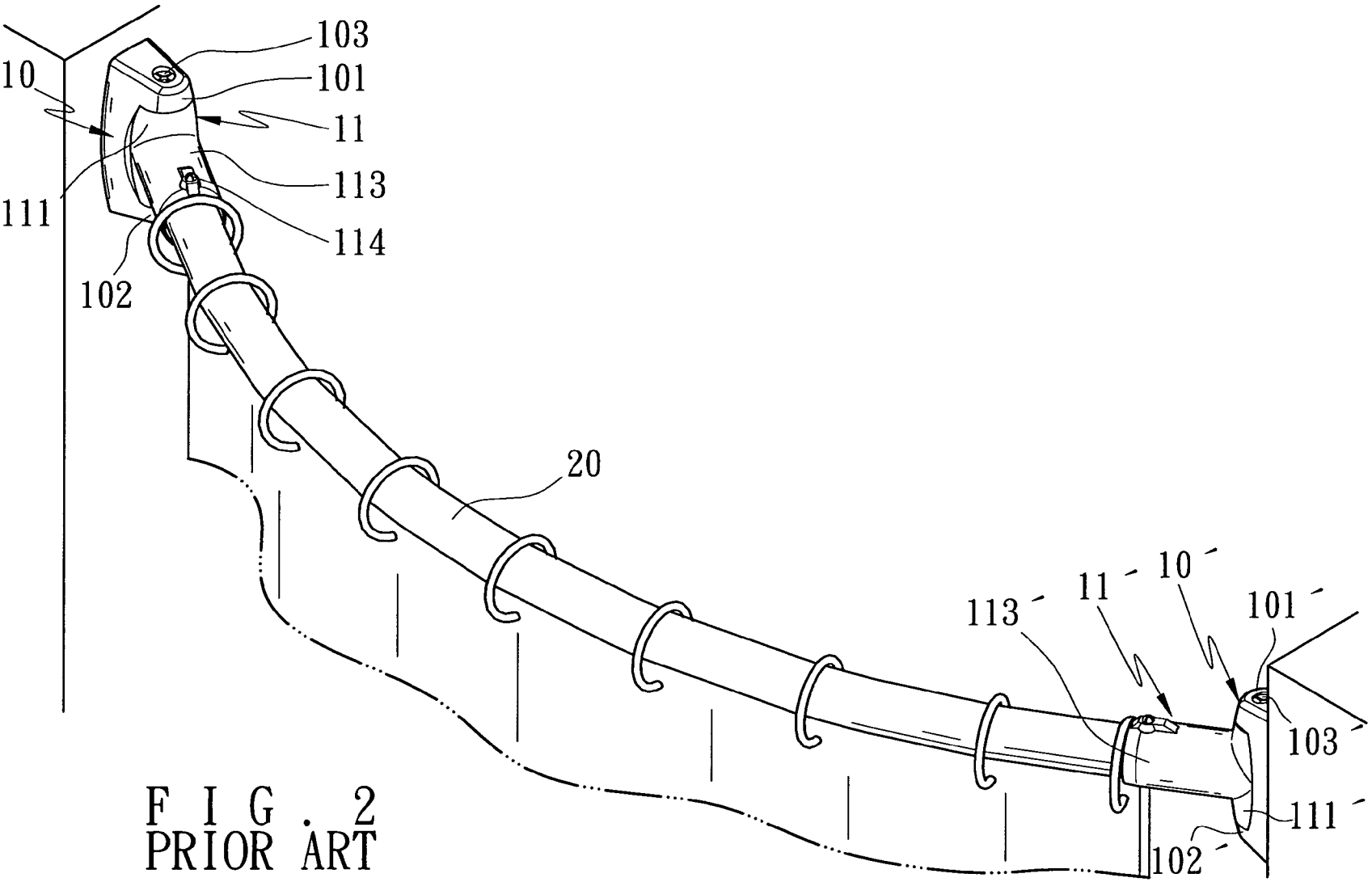
FIG 2 PRIOR ART
FIG. 2 is a perspective diagram illustrating the assembly of the prior art fixing structure of the rod member for use in shower curtains.
Figure 3:
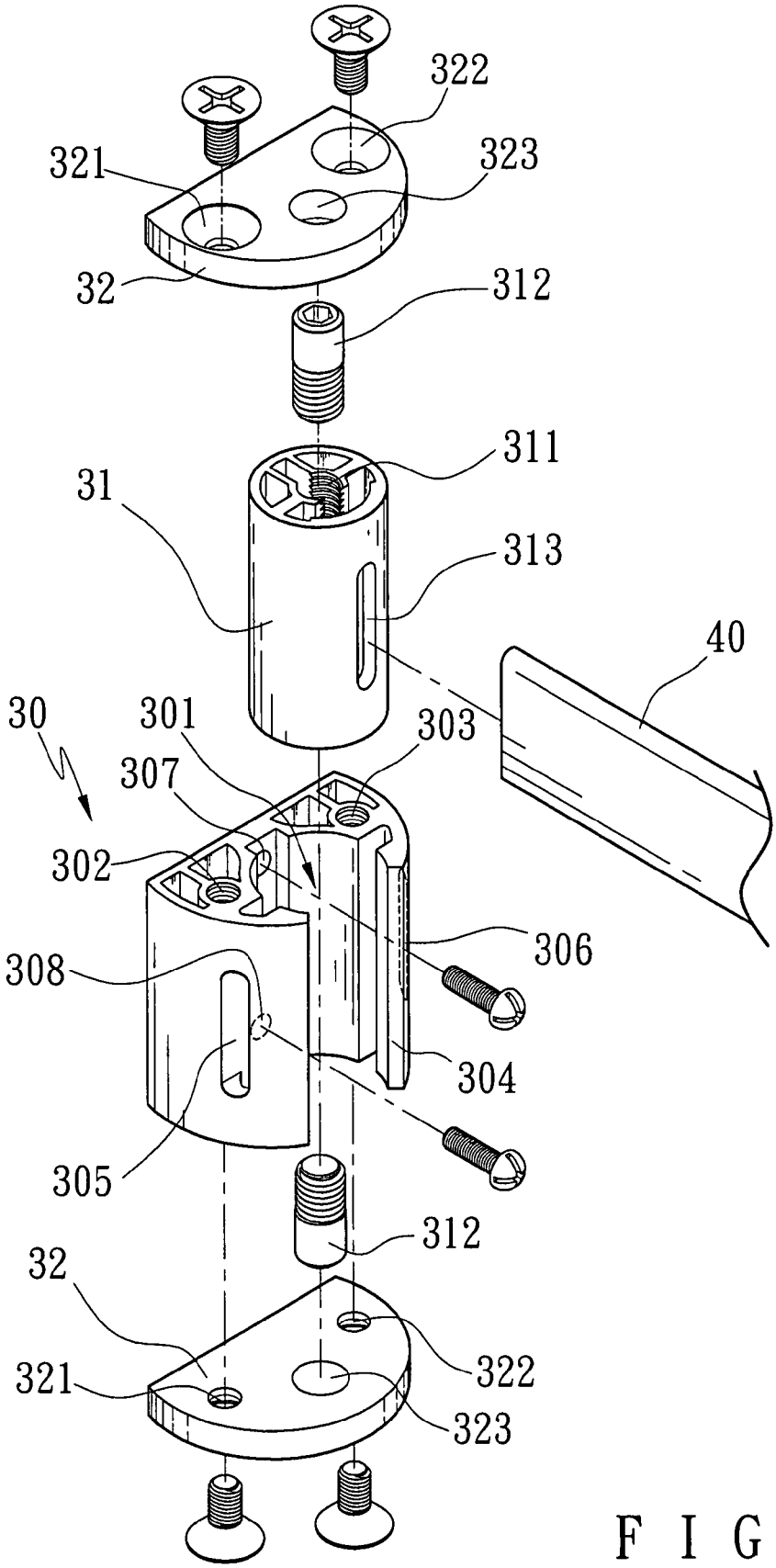
FIG. 3 is a perspective diagram illustrating the exploded components of a holder of a fixing structure of a rod member for use in shower curtains according to the present invention.

Referring to FIG. 3, a fixing structure of a rod member for use in shower curtains in accordance with the present invention comprises a holder 30 made of aluminum and extrusion formed, a connecting member 31 and two cover pieces 32. The holder 30 is constructed in the form of a semi-circular cylinder and includes a cylindrical fixing groove 301 arranged therein, and includes holes 302, 303 passing through the upper and lower end portions thereof. The fixing groove 301 includes a gap 304 provided at one side thereof and its width being less than the diameter thereof, the holder 30 further includes through slots 305 and 306 for the communication with the outer portion thereof disposed at left and right sides thereof respectively, and includes two bores 307 and 308 for communicating with the outer portion thereof mounted at another side thereof, such that the bolt elements may be fittingly fixed on the walls. The fixing groove 301 involves the connecting member 31 pivotally fitted therein and having an axial opening 311 with threads formed at the axially central position thereof for screwing with pivotal shafts 312 with threads, and includes an insertion notch 313 for the communication with the axial opening 311 attached on the outer peripheral surface thereof and formed in the shape of an elongated plane so as to insert a rod member 40 therein, and by way of the pivotal shafts 312 at two ends of the connecting member 31, the connecting member 31 may be pivotally positioned at different angles in the fixing groove 301. Furthermore, the holders 30 contains the cover pieces 32 arranged at two ends thereof and having two bores 321, 322 in response to the holes 302, 303 of the holder 30 provided thereon for inserting the bolt elements and then fixing the cover pieces 32 at two end portions thereof, and having an axial opening 323 in response to the connecting member 31 disposed thereon.

Figure 4:
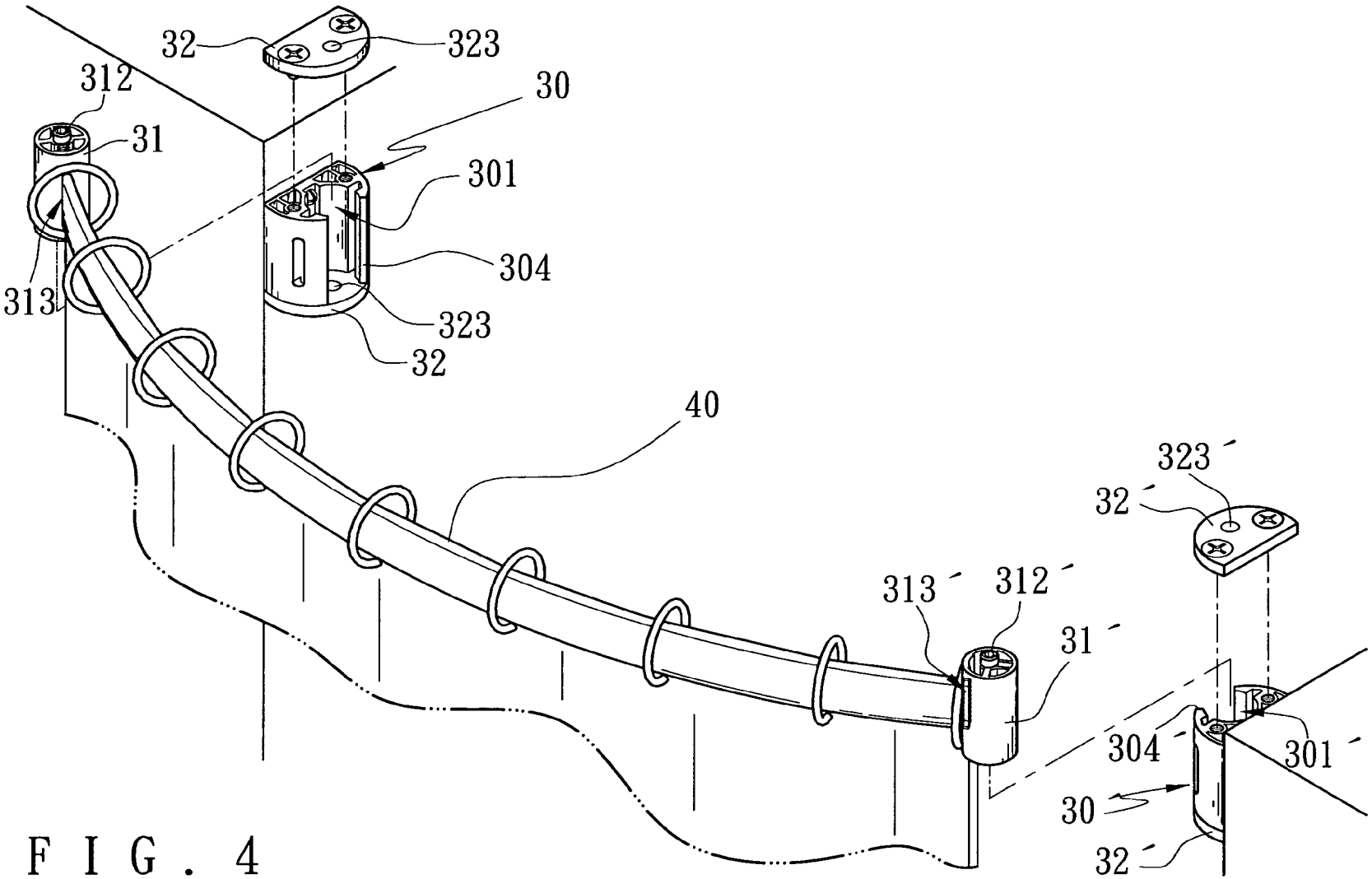
FIG. 4 is a perspective diagram illustrating the present invention being fixed on the walls.
Figure 5:
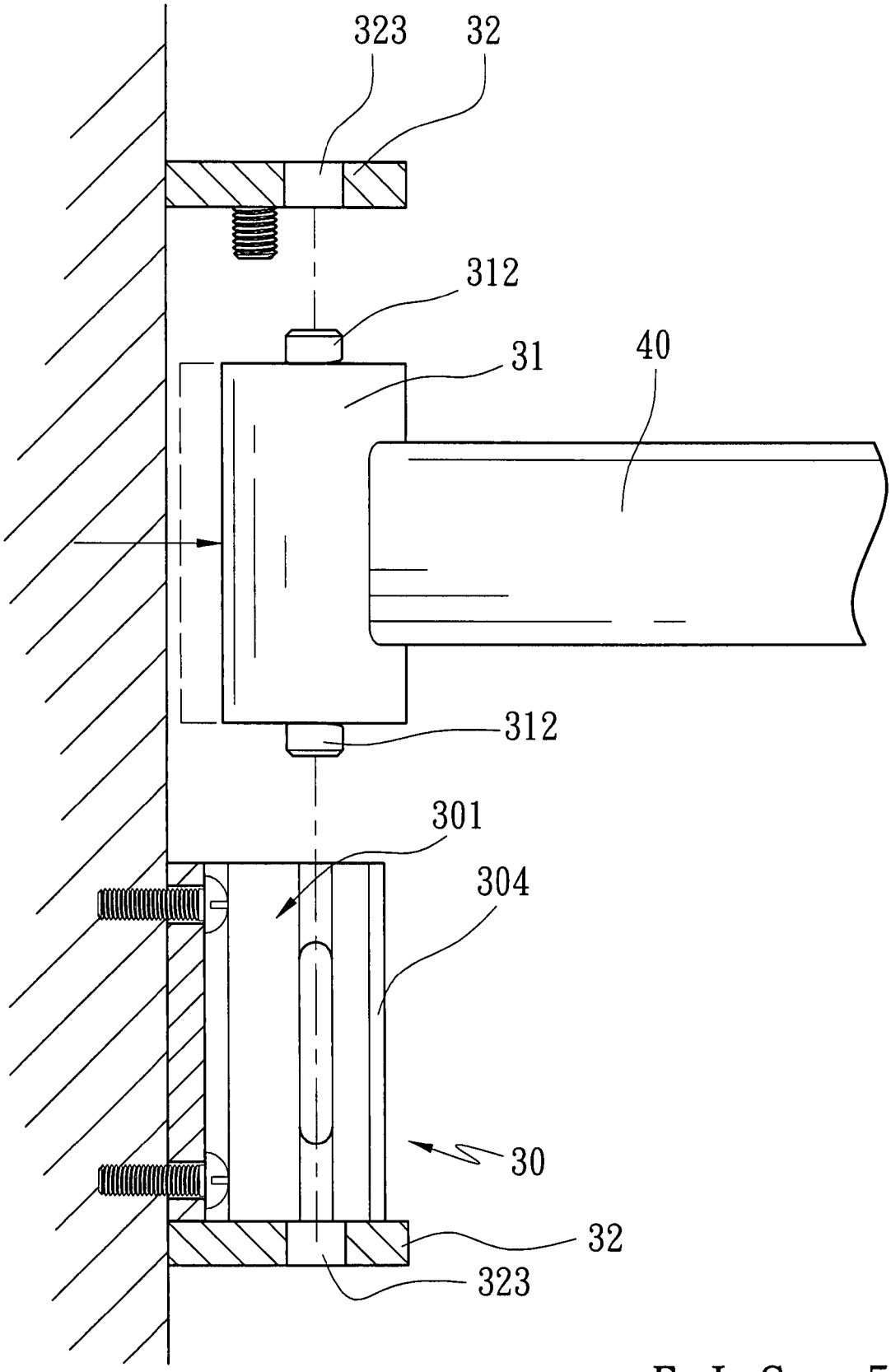
FIG. 5 is a cross sectional diagram of the fixing structure of the rod member for use in shower curtains according to the present invention.
Figure 6:
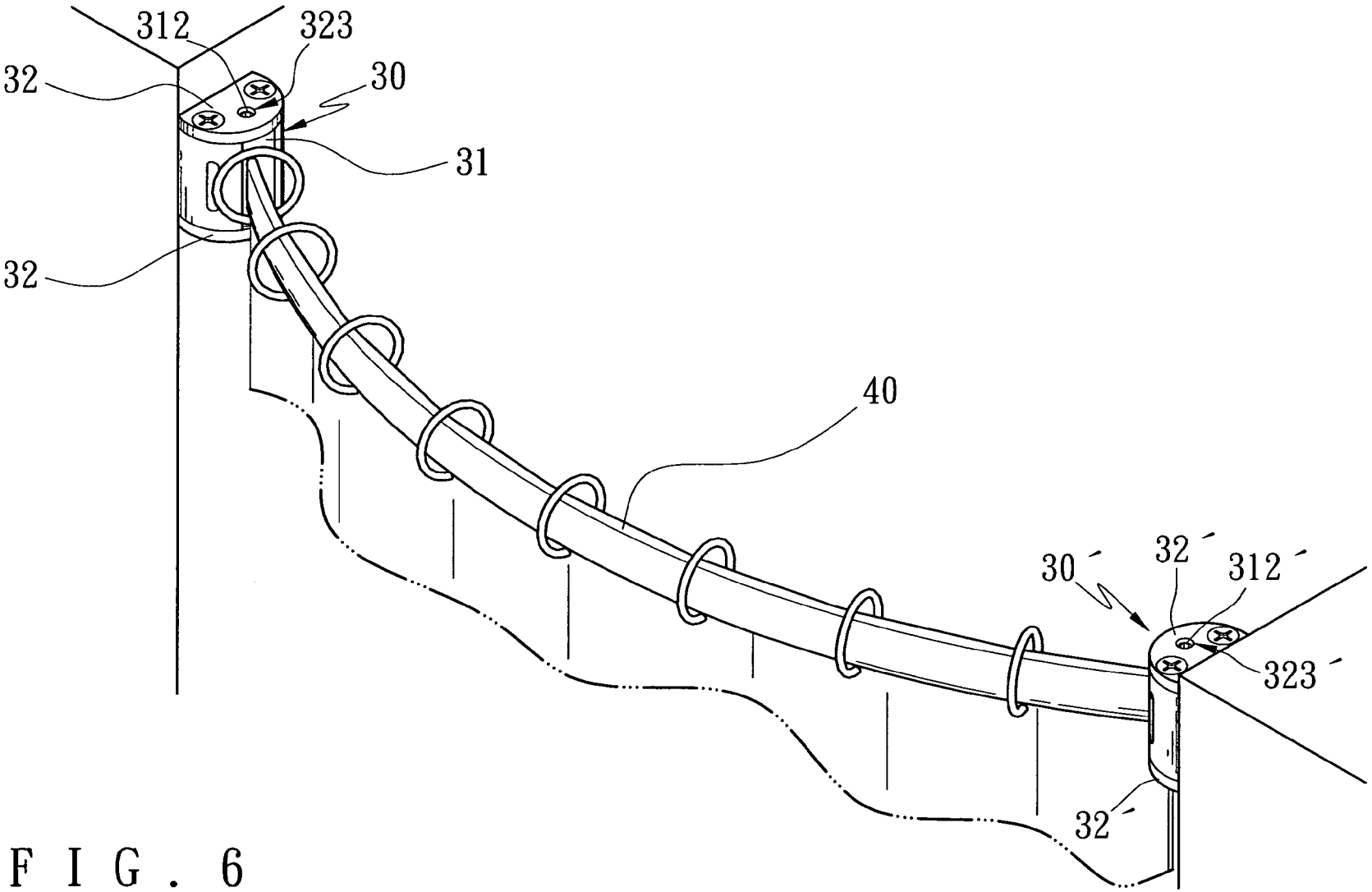
FIG. 6 is a perspective diagram illustrating the present invention being fixed on the walls.

In assembly, as shown in FIGS. 4-6, the cover pieces 32, 32' are screwed to the lower ends of the holders 30, 30' first, and then the two holders 30, 30' are fixed onto the walls by ways of the bolt elements. Besides, two ends of the bent rod member 40 are inserted into the insertion notches 313, 313' of the connecting members 31, 31', and the pivotal shafts 312, 312' are screwed in the connecting members 31, 31' so that one ends thereof abut against the rod member 40 for securing the connecting members 31, 31' to two ends of the rod member 40, and then the connecting members 31, 31' are placed into the fixing grooves 301, 301' of the holders 30, 30' such that the pivotal shafts 312, 312' are axially affixed in the axial openings 323, 323' of the cover pieces 32, 32', hence the rod member 40 projects out of the holders 30, 30' from the gaps 304, 304', and since the widths of the gaps 304, 304' are less than the diameters of the fixing grooves 301, 301', the connecting members 31, 31' are axially mounted in the fixing grooves 301, 301', such that if some errors result in between the relative positions of the holders 30, 30' and the connecting members 31, 31', the two ends of the rod member 40 allow to be pressed to cause a flexible deformation, and the connecting members 31, 31' are respectively in response to the fixing grooves 301, 301' of the holders 30, 30', thereby the connecting members 31, 31' are easy to axially fit in the fixing grooves 301, 301'. Moreover, the cover pieces 32, 32' are locked onto the upper ends of the holders 30, 30', and the pivotal shafts 312, 312' are axially mounted into the axial openings 323, 323' of the cover pieces 32, 32' for fixing the rod member 40.

Figure 7:
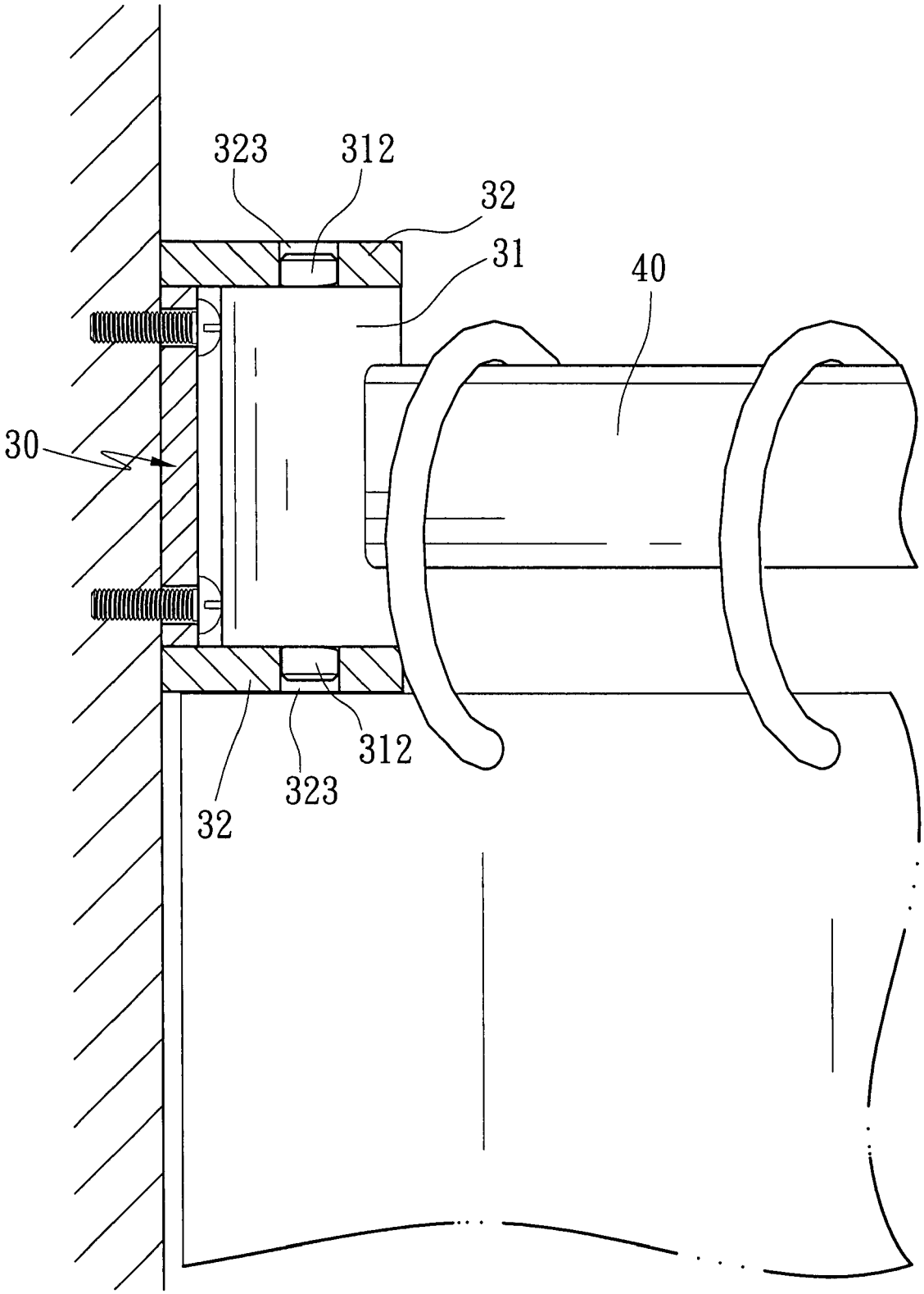
FIG. 7 is a partially enlarged sectional diagram illustrating the present invention being fixing on the wall.

With reference to FIGS. 6 and 7, after screwing the pivotal shafts 312, 312' to the two ends of the rod member 40 and the holders 30, 30', by using the connecting members 31, 31', the pivotal shafts 312, 312' may be further secured in the axial openings 323, 323' of the cover pieces 32, 32' so that the shower curtain is closely pulled to the holder 30 for decreasing the gaps between the shower curtain and the walls.

Figure 8:
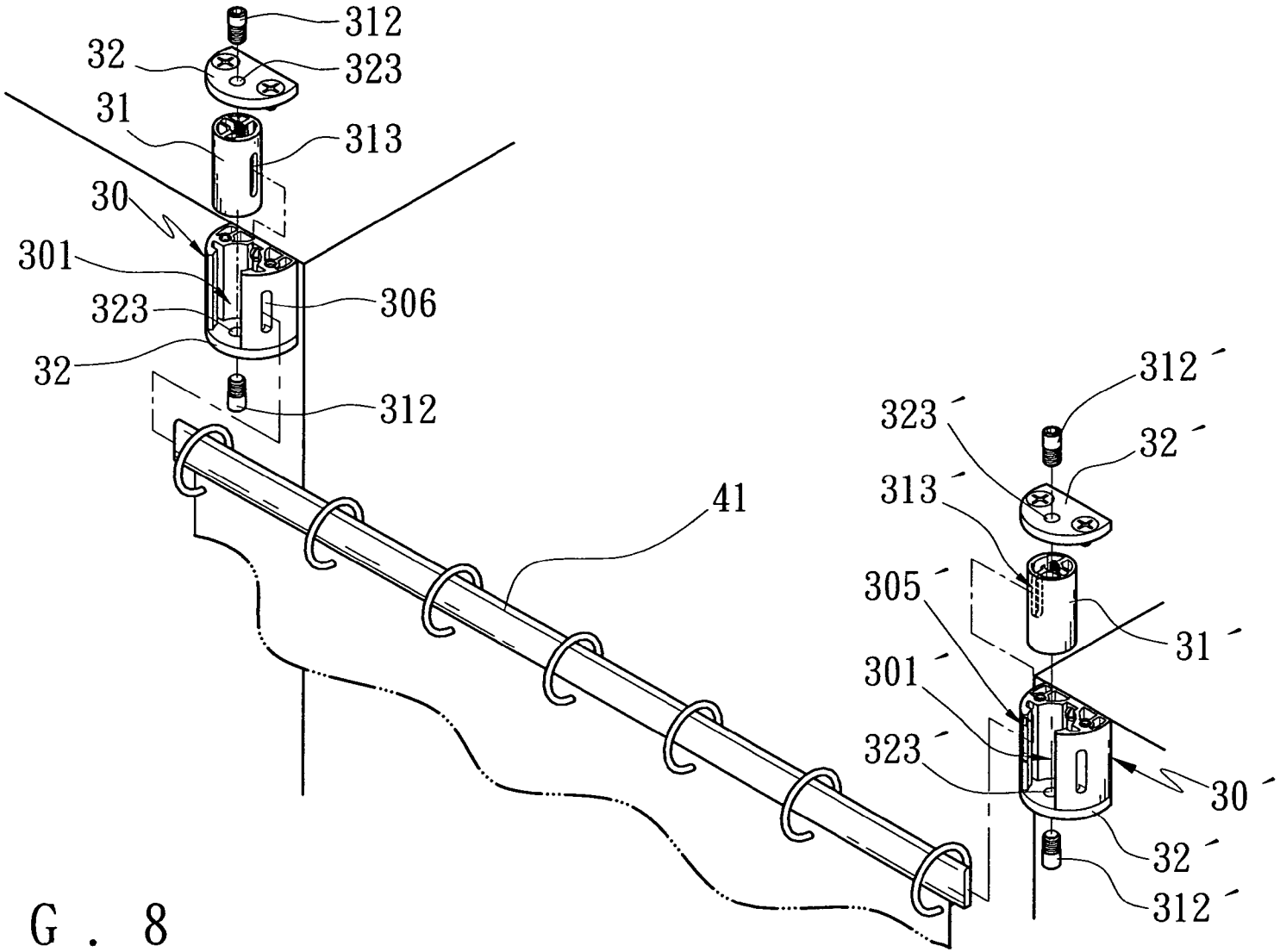
FIG. 8 is a perspective diagram illustrating the assembly of the fixing structure of the rod member for use in shower curtains according to another embodiment of the present invention.
Figure 9:
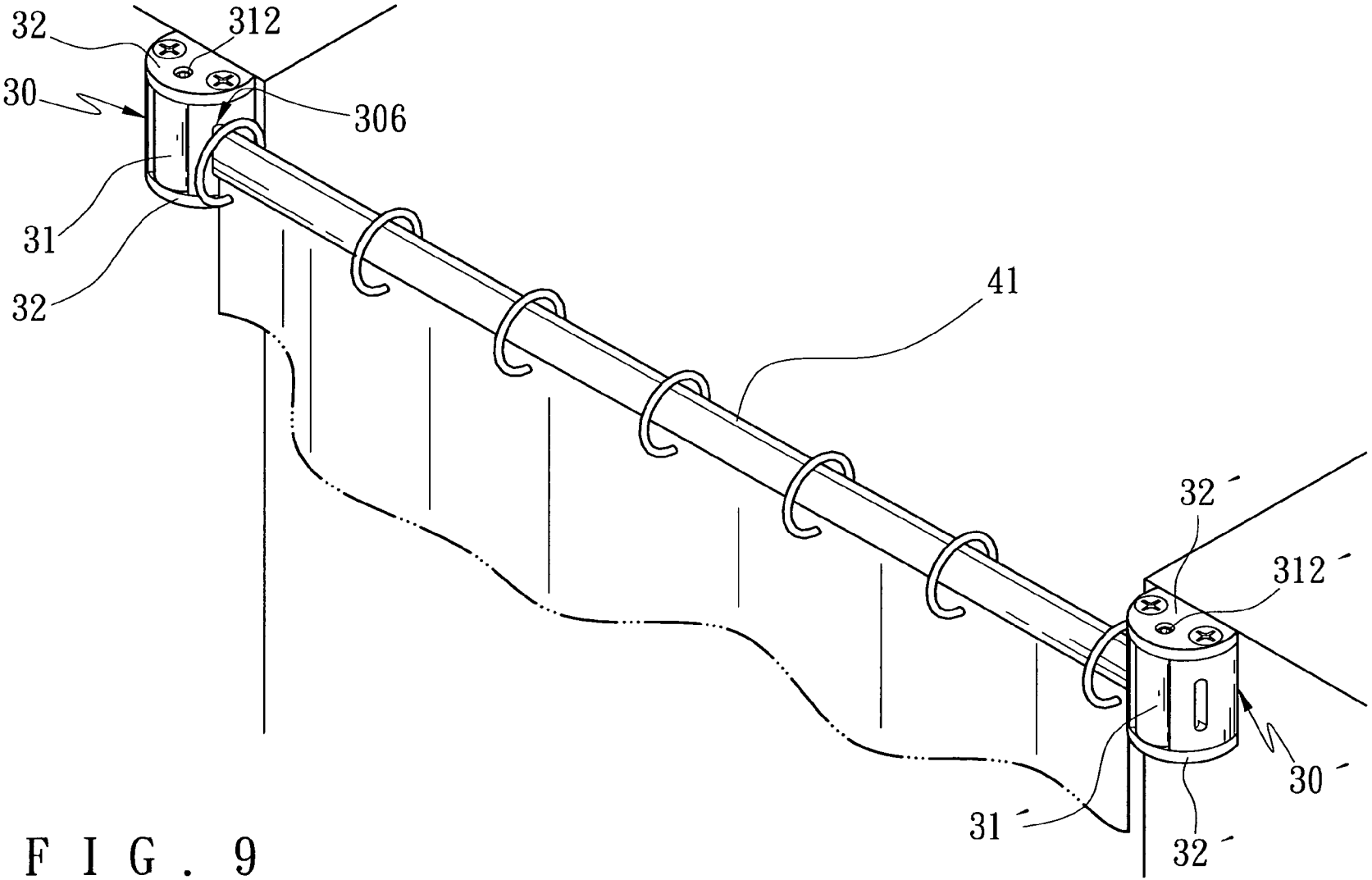
FIG. 9 is a perspective diagram illustrating the assembly of the fixing structure of the rod member for use in shower curtains according to another embodiment of the present invention.

As illustrated in FIGS. 8 and 9, in another embodiment of the present invention, the holders 30, 30' having the cover pieces 32, 32' screwed at the lower end portions thereof are fixed to the walls, and the connecting members 31, 31' are individually placed into the fixing grooves 301, 301' of the holders 30, 30', and the insertion notch 313 of the connecting member 31 is pivotally rotated to correspond to the through slot 306 of the holder 30, yet the pivotal shaft 312' of the connecting member 31' is axially rotated to correspond to the through slot 305' of the holder 30', then on the upper end portions of the holders 30, 30' are screwed the cover pieces 32, 32' individually. By pressing a flat-plated rod member 41, it will cause a flexible deformation to insert its two ends into the insertion notches 313, 313' of the connecting members 31, 31' through the through slots 306, 305' respectively, and then the pivotal shafts 312, 312' of the connecting members 31, 31' are screwingly positioned, thereby fixing the rod member 41.

Figure 10:
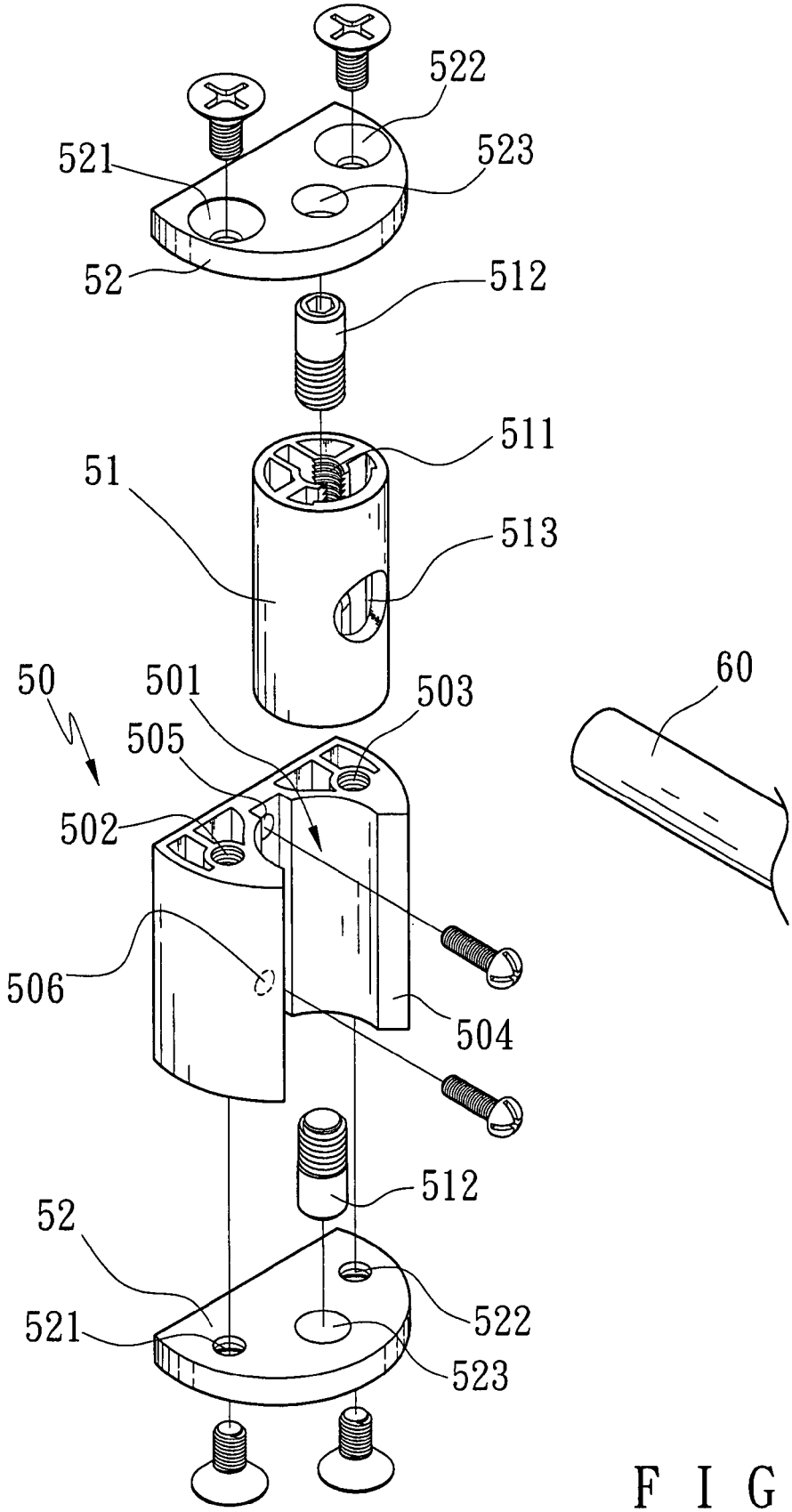
FIG. 10 is a perspective diagram illustrating the exploded components of the holder of the fixing structure of the rod member for use in shower curtains according to another embodiment of the present invention.

Referring further to FIG. 10, a fixing structure of a rod member for use in shower curtains according to another embodiment of the present invention comprises a holder 50 made of aluminum and extrusion formed, a connecting member 51 and two cover pieces 52. The holder 50 is constructed in the form of a semi-circular cylinder and includes a cylindrical fixing groove 501 arranged therein, and includes holes 502, 503 passing through the upper and lower end portions thereof. The fixing groove 501 includes a gap 504 provided at one side thereof and its width being less than the diameter of the fixing groove 501, and the holder 50 further includes two bores 505 and 506 for communicating with the outer portion thereof mounted at another side thereof, such that the bolt elements may be fittingly fixed on the walls. The fixing groove 501 involves the connecting member 51 pivotally affixed therein and having an axial opening 511 with threads secured at the axially central position thereof for screwing with pivotal shafts 512 with threads, and includes an insertion notch 513 for the communication with the axial opening 511 attached on the outer peripheral surface thereof and formed in the shape of an elongated plane so as to insert a rod member 60 therein, and by way of the pivotal shafts 512 at two ends of the connecting member 51, the connecting member 51 may be pivotally positioned at different angles in the fixing groove 501. Furthermore, the holders 50 contains the cover pieces 52 arranged at two ends thereof and having two bores 521 and 522 in response to the holes 502 and 503 of the holder 50 provided thereon for inserting the bolt elements and then fixing the cover pieces 52 at two end portions thereof, and having an axial opening 523 in response to the connecting member 51 disposed thereon.

Figure 11:
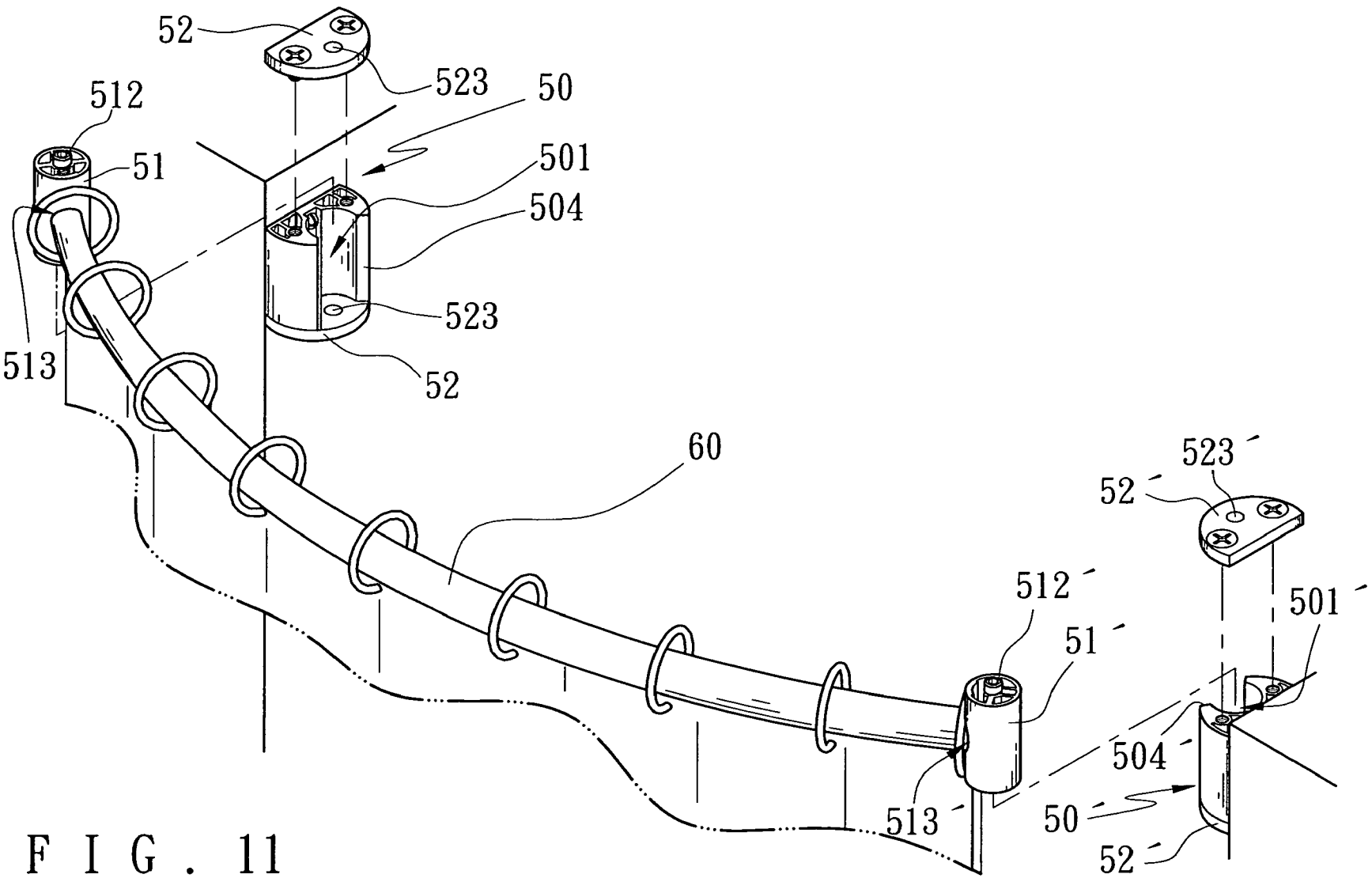
FIG. 11 is a perspective diagram illustrating the fixing structure of the rod member for use in shower curtains being fixed on the walls according to another embodiment of the present invention.
Figure 12:
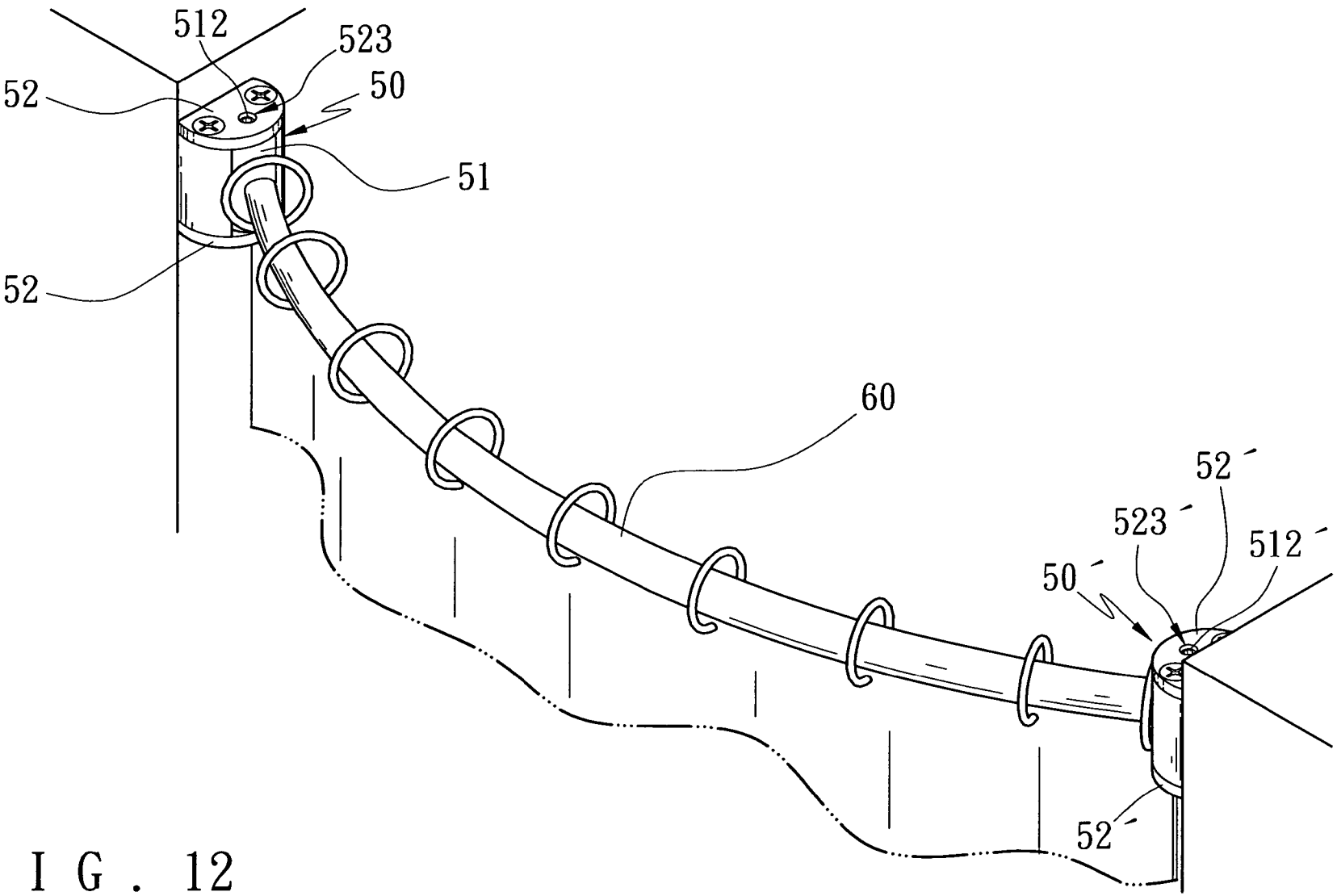
FIG. 12 is a perspective diagram illustrating the fixing structure of the rod member for use in shower curtains being fixed on the walls according to another embodiment of the present invention.

In assembly, as shown in FIGS. 11 and 12, the cover pieces 52, 52' are screwed to the lower ends of the holders 50, 50' first, and then the two holders 50, 50' are fixed onto the walls by ways of the bolt elements. Besides, two ends of the bent rod member 60 are inserted into the insertion notches 513, 513' of the connecting members 51, 51', and the pivotal shafts 512, 512' are screwed in the connecting members 51, 51' so that one ends thereof abut against the rod member 60 for securing the connecting members 51, 51' to two ends of the rod member 60, and then the connecting members 51, 51' are placed into the fixing grooves 501, 501' of the holders 50, 50' so that the pivotal shafts 512, 512' are axially affixed in the axial openings 523, 523' of the cover pieces 52, 52', hence the rod member 60 projects out of the holders 50, 50' from the gaps 504, 504', and since the widths of the gaps 504, 504' are less than the diameters of the fixing grooves 501, 501', the connecting members 51, 51' are axially mounted in the fixing grooves 501, 501'. Moreover, the cover pieces 52, 52' are locked onto the upper ends of the holders 50, 50', and the pivotal shafts 512, 512' are axially mounted into the axial openings 523, 523' of the cover pieces 52, 52' for fixing the rod member 60.

Figure 13:
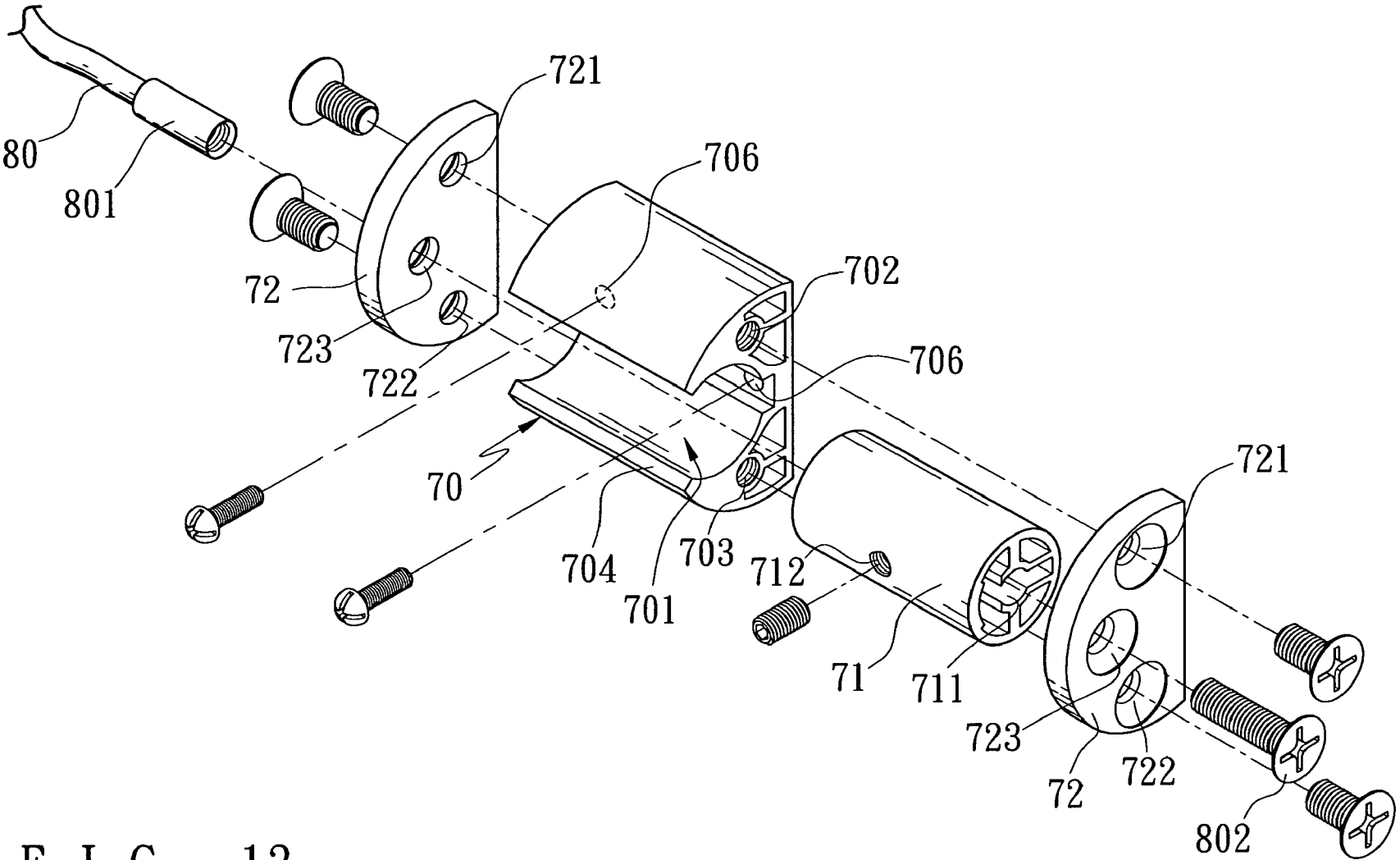
FIG. 13 is a perspective diagram illustrating the exploded components of the holder according to another embodiment of the present invention.

Referring further to FIG. 13, a fixing structure of a rod member for use in shower curtains according to another embodiment of the present invention comprises a holder 70 made of aluminum and extrusion formed, a connecting member 71 and two cover pieces 72. The holder 70 is constructed in the form of a semi-circular cylinder and includes a cylindrical fixing groove 701 arranged therein, and further includes holes 702, 703 passing through the upper and lower end portions thereof. The fixing groove 701 includes a gap 704 provided at one side thereof and its width being smaller than the diameter of the fixing groove 701, the holder 70 includes two bores 705 and 706 for communicating with the outer portion thereof mounted at another side thereof, such that the bolt element may be fittingly fixed on the wall. The fixing groove 701 further involves the connecting member 71 pivotally fitted therein and having an axial opening 711 secured at the axially central position thereof and having a hole 712 for the communication with the axial opening 711 formed on the outer peripheral surface thereof and for screwing with a pivotal shaft 713. Furthermore, the holder 70 contains the cover pieces 72 arranged at two ends thereof and having two bores 721, 722 in response to the holes 702, 703 of the holder 70 provided thereon for inserting the bolt elements and then fixing the cover pieces 72 at two end portions thereof, and having an axial opening 723 in response to the connecting member 71 disposed thereon. A rod member 80 having a flexible metal rope is inserted into the axial opening 711 of the connecting member 71, and one end thereof may be cut to a proper length for the accommodation of the distance between two walls, and at another end of the rod member 80 is mounted a fitting sleeve 801 for screwing with a bolt element 802.

Figure 14:
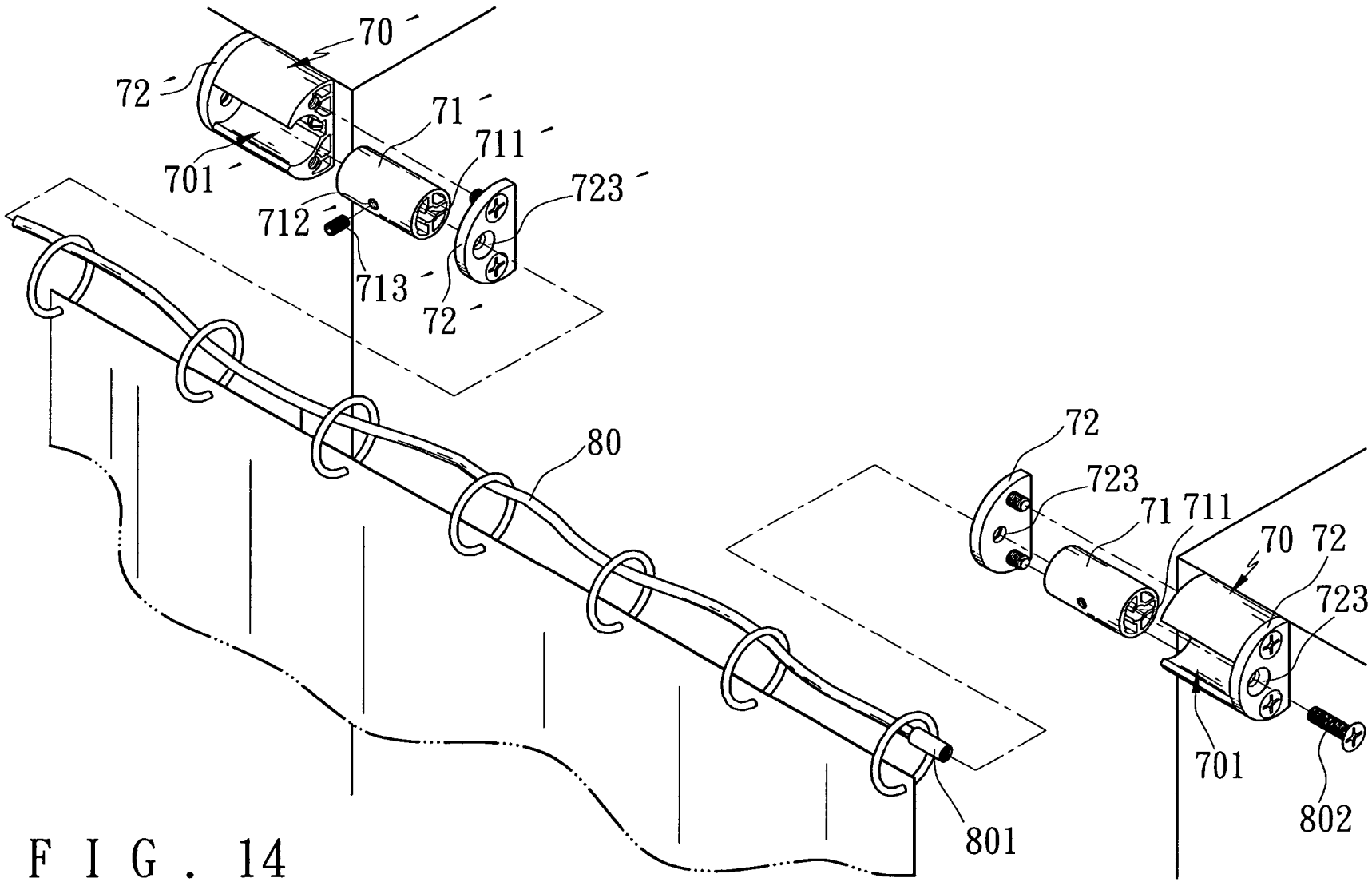
FIG. 14 is a perspective diagram illustrating the fixing structure of the rod member for use in shower curtains being fixed on the walls according to another embodiment of the present invention.
Figure 15:
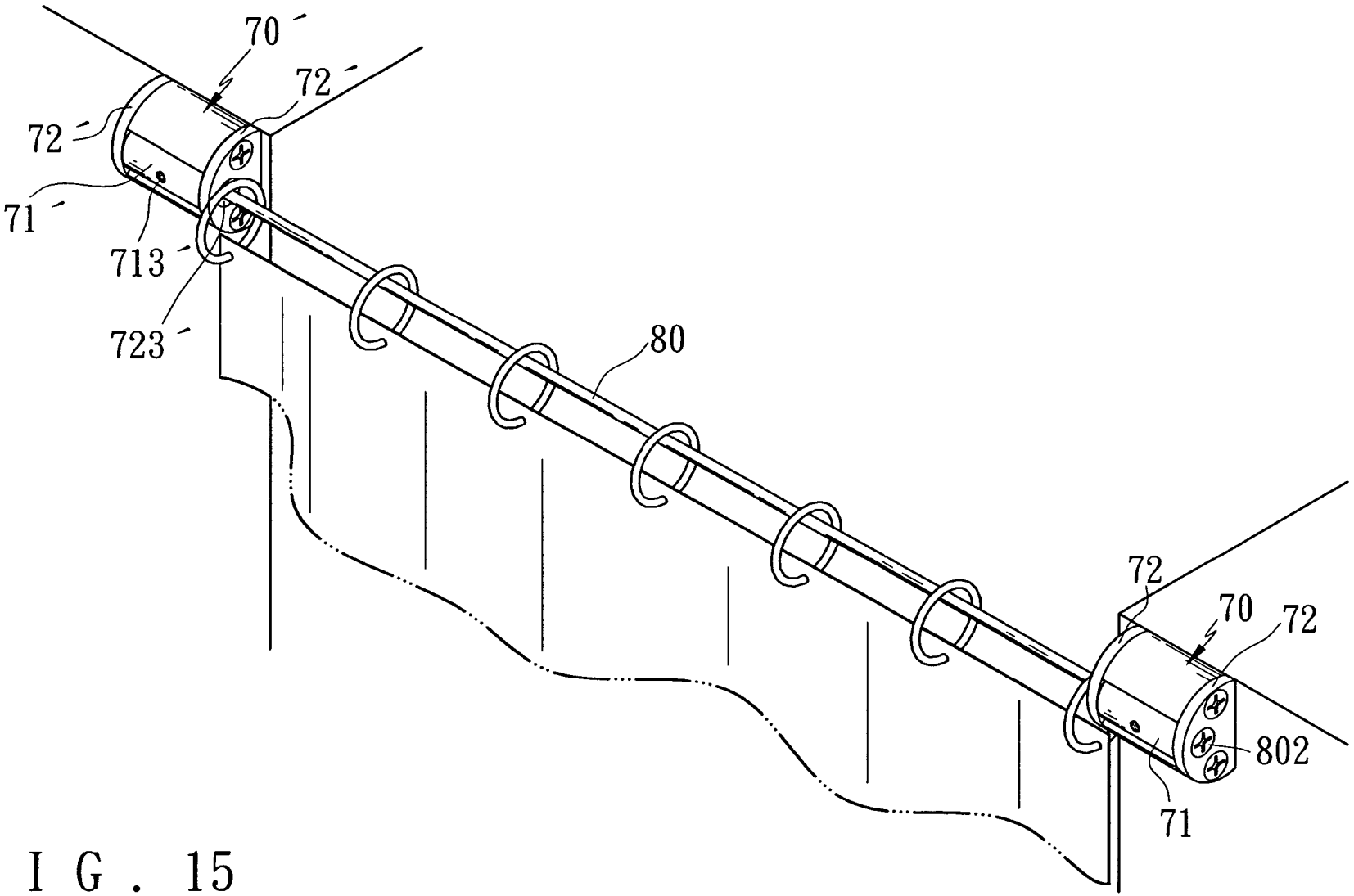
FIG. 15 is a perspective diagram illustrating the fixing structure of the rod member for use in shower curtains being fixed on the walls according to another embodiment of the present invention.

In assembly, as shown in FIGS. 14 and 15, the end portions of the two holders 70, 70' are screwed with the cover pieces 72, 72', and then by virtue of the bolt elements, the two holders 70, 70' are affixed onto the walls, and the connecting members 71, 71' are placed into the fixing grooves 701, 701' of the holders 70, 70', another ends of the holders 70, 70' are screwed with the cover pieces 72, 72', and one end of the rod member 80 with a proper length is inserted into the bores 723' of the cover piece 72' and the axial opening 711' of the connecting member 71', then the bolt element 713' of the connecting member 71' is locked and abutted against the rod member 80 so that one end of the rod member 80 is secured in the axial opening 711' of the connecting member 71', while the fitting sleeve 801 at another end thereof is inserted into the axial opening 711 of the connecting member 71 through the bore 723 of the cover piece 72, by using the bolt element 802 to insert into the bore 723 of the cover piece 72 for screwing with the fitting sleeve 801 of the rod member 8, the rod member 80 is pulled straightly and tightly, thereby fixing the rod member 80.

The invention is not limited to the above embodiment but various modifications thereof may be made. It will be understood by those skilled in the art that various changes in form and detail may made without departing from the scope and spirit of the present invention.

What is claimed is:

1. A fixing structure of a rod member for use in shower curtains comprising:

a holder, a connecting member and two cover pieces screwed at the end portions of said holder, wherein said holder includes a fixing groove formed therein and having a gap arranged at one side thereof with a width of the gap being less than the diameter of said fixing groove, and includes the connecting member axially disposed in said fixing groove thereof and having pivotal shafts mounted at two end portions thereof, and having an insertion notch for inserting the rod member therein secured on the outer peripheral surface thereof, and includes said cover pieces screwed at two end portions thereof and having axial opening in response to said pivotal shafts of said connecting member attached thereon.

2. The fixing structure of the rod member for use in shower curtains as claimed in claim 1, wherein said holder is made of aluminum and extrusion formed.

3. The fixing structure of the rod member for use in shower curtains as claimed in claim 1, wherein said fixing groove of said holder is constructed in the form of a cylinder.

4. The fixing structure of the rod member for use in shower curtains as claimed in claim 1, wherein said fixing groove of said holder includes two bores for communicating with the outer portion thereof mounted at another side thereof, such that bolt elements may be fittingly fixed on the walls.

5. The fixing structure of the rod member for use in shower curtains as claimed in claim 1, wherein said holder includes holes arranged at said two end portions thereof and communicating with the outer peripheral surface thereof for screwing with said cover pieces.

6. The fixing structure of the rod member for use in shower curtains as claimed in claim 1, wherein said holder further includes through slots for the communication with the outer portion thereof disposed at left and right sides thereof respectively.

7. The fixing structure of the rod member for use in shower curtains as claimed in claim 1, wherein said connecting member includes an axial opening with threads formed at an axially central position thereof for screwing with pivotal shafts with threads.

8. The fixing structure of the rod member for use in shower curtains as claimed in claim 1, wherein said fixing groove includes an insertion notch attached on the outer peripheral surface thereof and formed in the shape of an elongated plane for inserting an elongated-plane rod member.

9. The fixing structure of the rod member for use in shower curtains as claimed in claim 1, wherein said insertion notch is constructed in the form of a circle for inserting a circular rod member.

10. The fixing structure of the rod member for use in shower curtains as claimed in claim 1, wherein said cover piece contains two bores for screwing bolt elements on the ends of said holder.

11. A fixing structure of a rod member for use in shower curtains comprising:

a holder, a connecting member and two cover pieces screwed at the end portions of said holder, wherein said holder includes a fixing groove formed therein for axially affixing said connecting member, and said connecting member including an axial opening provided thereon, and said cover pieces, each having bores in response to said bores of said connecting member, attached on the end portions of said holder for inserting a rod member;

wherein said holder is made of aluminum and extrusion formed, and said fixing groove of said holder is constructed in the form of a cylinder; and wherein said fixing groove of said holder includes a gap provided at one side thereof and a width of the gap being less than the diameter of said fixing groove.

12. The fixing structure of the rod member for use in shower curtains as claimed in claim 11, wherein said fixing groove of said holder includes two bores for the communication with an outer peripheral surface thereof disposed at another side thereof for fittingly fixing bolt elements on the walls.

13. The fixing structure of the rod member for use in shower curtains as claimed in claim 11, wherein said connecting member involves a hole for the communication with said axial opening and for screwing with a pivotal shaft of said rod member formed on the outer peripheral surface thereof.

14. The fixing structure of the rod member for use in shower curtains as claimed in claim 11, wherein said cover pieces includes two bores for inserting said bolt elements on the end portions of said holder.

15. A fixing structure of a rod member for use in shower curtains comprising:

a holder, a connecting member and two cover pieces screwed at the end portions of said holder, wherein said holder includes a fixing groove formed therein for axially affixing said connecting member, and said connecting member including an axial opening provided thereon, and said cover pieces, each having bores in response to said bores of said connecting member, attached on the end portions of said holder for inserting a rod member;

wherein said holder includes holes arranged at two end portions thereof and communicating with the outer peripheral surface thereof for screwing with said cover pieces.

16. The fixing structure of the rod member for use in shower curtains as claimed in claim 15, wherein said rod member includes a flexible metal rope.

17. The fixing structure of the rod member for use in shower curtains as claimed in claim 15, wherein one end of said rod member may be cut to a proper length for the accommodation of the distance between the two walls, and at another end of side rod member is mounted a fitting sleeve for screwing with a bolt element.

* * * * *